United States Patent [19]

Bamer et al.

[11] Patent Number: 4,465,031

[45] Date of Patent: Aug. 14, 1984

[54] IGNITION PLUG WITH IGNITION CHAMBER, AND INTERNAL COMBUSTION ENGINE PROVIDED THEREWITH

[75] Inventors: Franz Bamer; Erich Breuser; Reinhard Latsch, all of Vaihingen, Fed. Rep. of Germany

[73] Assignee: Robert Bosch GmbH, Stuttgart, Fed. Rep. of Germany

[21] Appl. No.: 408,659

[22] Filed: Aug. 16, 1982

[30] Foreign Application Priority Data

Feb. 25, 1982 [DE] Fed. Rep. of Germany ..... 3206708

[51] Int. Cl.[3] ..... F02B 19/12; F02B 19/18

[52] U.S. Cl. ..... 123/260; 123/263; 123/266; 123/293

[58] Field of Search ..... 123/143 B, 169 EZ, 254, 123/255, 256, 260, 263, 266, 267, 281, 282, 283, 285, 293

[56] References Cited

U.S. PATENT DOCUMENTS 2,223,090 11/1940 Boxan ..... 123/293 X
4,327,681 5/1982 Latsch et al. ..... 123/293 X
4,361,122 11/1982 Latsch ..... 123/293 X

FOREIGN PATENT DOCUMENTS 136259 1/1934 Austria ..... 123/293
2045805 3/1972 Fed. Rep. of Germany ..... 123/169 PA

*Primary Examiner*—Parshotam S. Lall
*Assistant Examiner*—W. R. Wolfe
*Attorney, Agent, or Firm*—Michael J. Striker

[57] ABSTRACT

An ignition plug for an internal combustion engine, and an internal combustion engine provided therewith, has first and second ignition chamber parts communicating with one another, an electrode supported on an insulator and a mass electrode and at least one overflow passage arranged to communicate with a main combustion chamber of the internal combustion engine with an ignition chamber of the ignition plug, wherein the overflow passage is open directly into the second ignition chamber part from an end wall bounding the first ignition chamber part and is located inside an inner parallel surface of a circumferential wall of the second ignition chamber part.

12 Claims, 3 Drawing Figures

IGNITION PLUG WITH IGNITION CHAMBER, AND INTERNAL COMBUSTION ENGINE PROVIDED THEREWITH

BACKGROUND OF THE INVENTION

The present invention relates to an ignition plug and an internal combustion engine provided therewith. More particularly, it relates to an ignition plug in which an ignition chamber is composed of two ignition chamber parts communicating with one another and with a main combustion chamber.

One such ignition plug is disclosed, for example, in German Offenlegungsschrift No. 2,951,029. It is suitable for igniting an ignition-unfavorable fuel-air mixture and has an ignition chamber with a narrower and a wider ignition part, wherein an annular mass electrode and an electrode supported by an insulator are arranged inside the ignition chamber in the region of transition between the narrower and wider ignition chamber parts. The electrode carried by the insulator extends through the wider ignition chamber part and the mass electrode and projects into the narrower ignition chamber part. The electrode carried by the insulator is formed as a heating pipe and is heated by a heating resistor united with the insulator. In the ignition chamber part of greater diameter has overflow passages which converge to its axis of symmetry toward the connection of this ignition chamber part with a main combustion chamber of an internal combustion engine. The ignition chamber part with the smaller diameter has tangentially directed overflow passages. During the compression stroke of the internal combustion engine in which the ignition plug is screwed, the fuel-air mixture flows through the converging overflow passages into the wider ignition chamber part and through the tangentially directed overflow passages in the narrower ignition chamber part and forms there between their circumferential wall and the heated electrode a twisted flow propagating toward the wider chamber part. This electrode is preheated either by the heating resistor or during the operation of the internal combustion engine by hot gases and maintained at an advantageous temperature. The fuel-air mixture flows along this electrode and becomes ignition-favorable prior to reaching the mass electrode. This ignition plug, however, has certain disadvantages, in the sense of its ignition properties.

SUMMARY OF THE INVENTION

Accordingly, it is an object of the present invention to provide an ignition plug for an internal combustion engine, and an internal combustion engine provided with the ignition plug, which avoid the disadvantages of the prior art.

In keeping with these objects, and with others which will become apparent hereinafter, one feature of the present invention resides, briefly stated, in an ignition plug in which an overflow passage which connects the main combustion chamber of the internal combustion engine with an ignition chamber of an ignition plug opens directly into a second ignition chamber part from an end wall of a first ignition chamber part and is arranged inside an inner surface of a circumferential wall of the second ignition chamber part. Another feature of the present invention is an internal combustion engine which is provided with the ignition plug formed as described hereinabove.

When the ignition plug and the internal combustion engine are designed in accordance with the present invention, the ignition in the region of the ignition spark gap is disorted less by residual gas produced by a preceding combustion and not completely removed. Because of the absence of the overflow passage opening directly into the narrow ignition chamber part, the ignition plug can be manufactured at lower cost. Moreover, the insulator which is heated by the combustion gases forms a preheating path for the ignitable mixture flowing on it along the ignition spark gap.

During full-load operation, the foot of the insulator is cooled in particularly advantageous manner. Because of the predetermined arrangement of the remaining passages, a suitable flow along the insulator and the electrode towards the ignition spark gap and the narrower ignition chamber part takes place, so that the mixture located inside the ignition spark gap in the ignition time moment is heated in desirable manner and thereby becomes ignition-favorable. Because of the deflection inside the flow, an advantageous centrifugal arrangement in layers takes place in the wider ignition chamber part, which serves for a fuel enrichment in the ignition spark gap.

In accordance with another advantageous feature of the present invention, the second ignition chamber is cylindrical and has a longitudinal axis, and the overflow passage extends parallel to the longitudinal axis of the second ignition chamber part. When the ignition plug is designed in accordance with this feature, it is easier to manufacture.

Still another feature of the present invention is that the overflow passage is inclined to the circumferential direction of the ignition chamber part. In such a construction, a turning or twisting movement is imparted to the inflowing mixture, so that the flow inside the ignition chamber is stabilized and provides for fast flame propagation after the ignition in the region of the ignition spark gap.

Yet another feature of the present invention is that the overflow passages are uniformly distributed over the circumferential wall of the second ignition chamber. This feature contributes to the formation of desirable flow of the mixture to be ignited.

A further feature of the present invention is that the first ignition chamber is bounded by a cap-shaped casing which includes the above-mentioned end wall and a flange which extends substantially radially from the end wall and formed as a cap brim, wherein the overflow passages are formed in the flange of the casing. When the ignition plug or the internal combustion engine is designed in accordance with these features, this particular individual part of the ignition plug can be manufactured in economical manner by extrusion or deep-drawing and bunching.

Still a further feature of the present invention is that the ignition plug has a support and a hollow collar arranged so that the second ignition chamber part is formed inside the hollow collar. When the ignition plug is designed in accordance with these features, the ignition chamber can be inserted in a simple manner into an internal combustion engine wall, particularly composed of light metal.

Yet a further feature of the present invention is that the cap-shaped casing is mounted on a free end of the collar. As a result of this, a structural unit is formed which facilitates equipping of an internal combustion engine with an ignition plug and ignition chamber.

An additional feature of the present invention is that a heating resistor is united with the insulator. In this construction the insulator can be brought to a desired preheating temperature especially fast, if the internal combustion engine is started in cold condition. It is also possible to obtain an advantageous operational temperature in idle running and during low loading of the internal combustion engine, by connecting of the heating resistor.

When the heating resistor is composed of a PTC resistance material, maintaining of a narrow temperature range within the desired operational temperatures of the insulation feet is simplified.

Yet an additional feature of the present invention is that the insulator has an insulator foot extending in the second ignition chamber part, and the heating resistor is arranged in the insulator foot. It is also possible that the heating resistor is formed as an electrically conductive coating provided on the insulator foot. In such a construction the electrical heating of the insulator during cold starts or low loading of the internal combustion engine is obtained at the location where heat is transferred to the heated mixture. Undesirable heat withdrawal to the supporting part of the ignition plug is considerably reduced. The arrangement of the heating resistor in the insulated foot is more material-economical.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
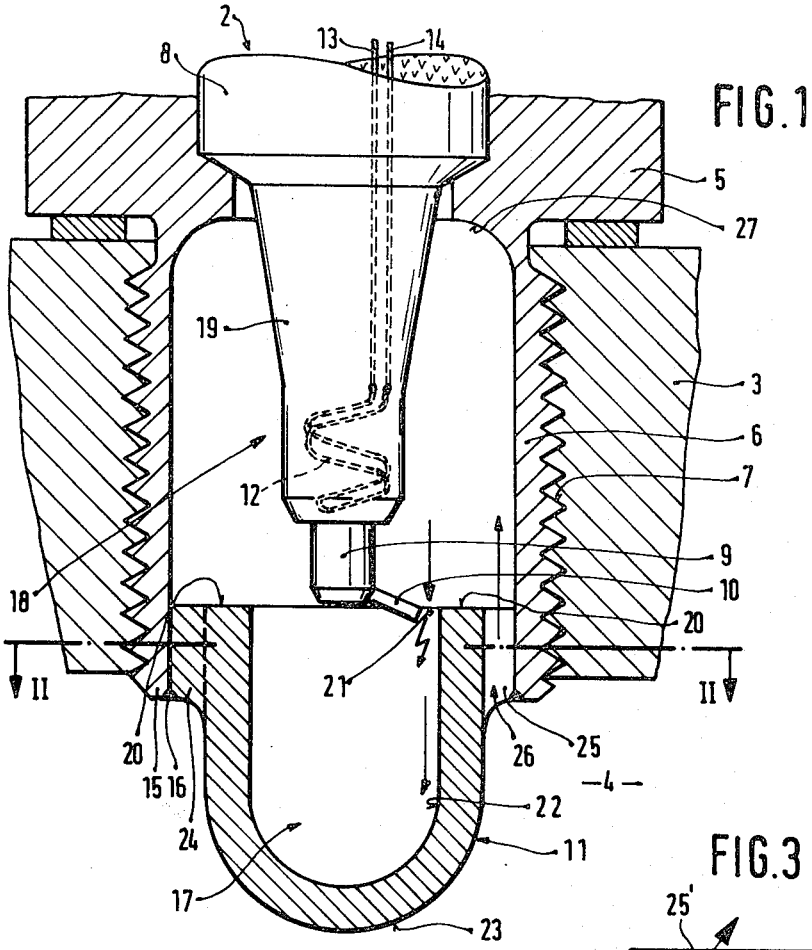
FIG. 1 is a view showing a longitudinal section of an ignition plug and a portion of a main combustion chamber of an internal combustion engine, in accordance with the present invention.
Figure 2:
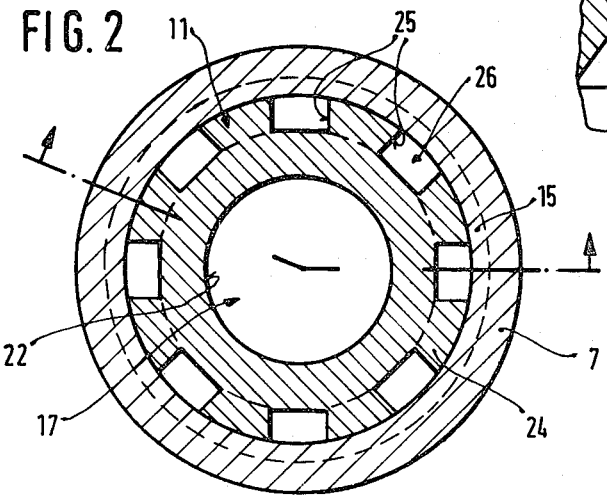
FIG. 2 is a section of the construction shown in FIG. 1.

An ignition plug in accordance with the invention is identified in toto by reference numeral 2 and is provided for an internal combustion engine having a wall 3 which bounds a main combustion chamber 4.

The ignition plug 2 has a support 5 with a hollow collar 6 and a thread 7 surrounding the latter. An insulator 8 is inserted in the support 5, and an electrode holder 9 extends outwardly beyond the insulator and carries an electrode 10. The ignition plug further has a cap-shaped structural element 11, a heating resistor 12, and conductors 13 and 14 connected with the latter.

The cap-shaped structural element 11 is inserted in a free end 15 of the collar 6 and connected with the latter by a welding seam 16. The cap-shaped structural element 11 borders the main combustion chamber 4 of the internal combustion engine or extends into the latter. A first ignition chamber part 17 is located inside the structural element 11. A second ignition chamber part 18 is located inside the sleeve 6 adjoining the insulator 8. The second ignition chamber part 8 communicates with the first ignition chamber part 17.

The insulator 8 has an insulator foot 19 extending into the collar 6 in direction of the structural element 11. The electrode holder 9 extends outwardly beyond the insulator foot 19. The electrode holder extends substantially to a wet end 20 of the structural element 11 which extends in the collar 6. The end 20 serves as a mass electrode. The electrode 10 extending from the electrode holder 9 ends at a distance to end 20 so as to form an ignition spark gap 21.

The heating resistor 12, which is located in the insulator foot 19, is connected with the connecting conductors 13 and 14 and composed, for example, of a PTC resistance material. The heating resistor 12 can also be formed as a current-conductive coating on the insulator foot 19. The connecting conductors 13 and 14 lead in the interior of the insulating foot 19 and from there into the insulator 8 and finally end on a not shown connecting means.

The cap-shaped structural element 11, formed, starting from its end 20, a cylindrical chamber wall 22, and an end wall 23 extending to the main combustion chamber 4. The sleeve 6 forms a circumferential wall for the second ignition chamber part 18. The diameter of the second ignition chamber part 18 is greater than the diameter of the first chamber part 17. The structural element 11 has a flange 24 projecting in a radial direction toward the sleeve 6 forming a cap brim. Grooves 25 are provided in the flange 24 and form together with the inner circumference of the sleeve 6 overflow passages 26. The overflow passages 26 communicates the second ignition chamber part 18 with the main combustion chamber 4.

During a compression stroke of this internal combustion engine, a fuel-air mixture to be ignited flows through the passages 26 into the second ignition chamber part 18 along the inner periphery of the sleeve 6. The mixture flows in the direction of the insulator 8 and is deflected from the insulator-side and the end 27 of the ignition chamber part 18 radially toward the insulator foot 19. The insulator foot 19 also deflects the mixture substantially in its lognitudinal direction, whereby the mixture flows on the insulator foot 19 along and over the heat resistor 12 in direction of the first ignition chamber part 17. During flowing over the insulator foot 19 or the heating resistor 12, these structural parts, having a predetermined temperature, increase the temperature of a the mixture. In the event of cold internal combustion engine, it is heated by the heating resistance 12 and also the insulator foot 19 is heated to an advantageous temperature. In the case when the internal combustion engine has been in operation during a certain time, the stream which flows through the heating resistor can be at least temporarily turned on or reduced. Overheating, which can release an uncontrolled ignition, can be avoided when the heating resistor 12 is composed of a material with PTC properties. It is known that when the heating resistor is formed in such a manner, the stream consumption is considerably reduced with increases in temperature, so that an automatic regulation takes place.

Figure 3:
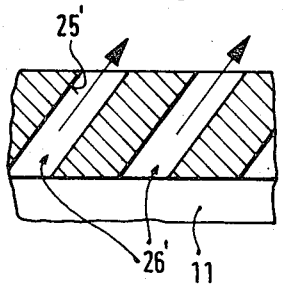
FIG. 3 is a side view of a portion of the ignition plug in accordance with a second embodiment of the invention.

In the above described embodiment of the invention, the grooves 25, which form the passages 26, extend parallel to the longitudinal axis of the ignition chamber part 18 and distribute uniformly over the circumference of the structural element 11 or are at least arranged in a mirror-symmetrical manner. In contrast, grooves 25' in the structural element 11 in accordance with another embodiment of the invention shown in FIG. 3 can be inclined or formed as a thread. These grooves form together with the collar 6 overflow passages 26' having axial and tangential components relative to the ignition chamber part 18. The inclined line and parallel line to the longitudinal axis of the ignition chamber can have an angle of for example 60°.

In such a construction, streams are formed inside the ignition chamber part 18, which have speed components around its longitudinal axis. This provides for stabilizing of the streams, an orderly longitudinal stream to the insulator foot 19 with the associated heating resistor 12, and the ignition spark gap 21 as well as the chamber part 17. In the region of the ignition spark gap 21 a stream develops with a circumferential speed which after the ignition of the mixture by the electrodes 10, 20 provides for fast flame propagation in the circumferential direction so that the ignition torch flare acts practically simultaneously from all passages 26' in the main combustion chamber 4 and ignite the mixture accommodated therein.

The above described formation of the stream has, because of its radial acceleration, also the advantage of a desirable fuel distribution inside the inflowing mixture. This fuel distribution makes possible reliable ignition of a mixture which has a considerable air surplus in its cross section, for example more than 20%. The ignition chamber parts 17 and 18 are shown in FIG. 1 as having hollow cylindrical shapes. In contrast, the ignition chamber parts 17 and 18 can be formed as hollow cones or halves of hollow ellipsoids.

The arrangement of the ignition spark gap 21 provides for a considerable advantage. It resides in the fact that, because of the design of the ignition plug 2, the ignition spark gap 21 is at only a short distance from the passages 26 or 26', so that after the igntiion only a very short time expires until the ignition torch flare extends from the above mentioned passages and act in the main combustion chamber 4. Thereby the internal combustion engine operates with less premature ignition which, as known, provides for a high efficiency because of aproximation to the so-called constant-volume cycle.

It will be understood that each of the elements described above, or two or more together, may also find a useful application in other types of constructions differing from the types described above.

While the invention has been illustrated and described as embodied in an ignition plug with an ignition chamber for an internal combustion engine, and an internal combustion engine provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An internal combustion engine, comprising means forming a main combustion chamber for receiving a mixture; and an ignition plug having means forming an ignition chamber with a first ignition chamber part having an end wall which separates said first ignition chamber part from said main combustion chamber of said internal combustion engine and is completely sealed so that said first ignition chamber part does not directly communicate with said main combustion chamber, and a second ignition chamber part communicating with said first ignition chamber part and having a circumferential wall with an inner surface and a greater cross section than said first ignition chamber part, electrode means including an electrode supported on an insulator and a mass electrode arranged in the region of transition between said first and second ignition chamber part and forming together with said electrode an ignition spark gap, said second ignition chamber part being arranged adjacent to said first ignition chamber part at the side of said electrode, and forming at least one overflow passage arranged to communicate the main combustion chamber with said ignition chamber, said overflow passage being open directly into said second ignition chamber part from said end wall of said first ignition chamber part and is located inside said inner surface of said circumferential wall of said second ignition chamber, so that said first ignition chamber part communicates with said main combustion chamber through said second ignition chamber part, said overflow passages additionally supplying said first ignition chamber part with said mixture over a route which goes on and along said electrode means.

2. An ignition plug for an internal combustion engine having a main combustion chamber, the ignition plug comprising means forming an ignition chamber including a first ignition chamber part which has an end wall separating said first ignition chamber part from said main combustion chamber of said internal combustion engine, and a second ignition chamber part which communicates with said first ignition chamber part and has a circumferential wall with an inner parallel surface and a greater cross section than said first ignition chamber part; electrode means including an electrode supported on an insulator, and a mass electrode arranged in the region of transition between said first and second ignition chamber parts and forming together with said electrode an ignition spark gap, said second ignition chamber part being arranged adjacent to said first ignition chamber part at the side of said electrode, said electrode means including a heating resistor united with said insulator, said insulator having an insulator foot extending into said second ignition chamber part, said heating resistor being arranged in said insulator foot; and means forming at least one overflow passage arranged to communicate the main combustion chamber with said ignition chamber, said overflow passage being open directly into said second ignition chamber part from said end wall of said first ignition chamber part and is located inside said inner parallel surface of said circumferential wall of said second ignition chamber.

3. An ignition plug for an internal combustion engine having a main combustion chamber, the ignition plug comprising means forming an ignition chamber including a first ignition chamber part which has an end wall separating said first ignition chamber part from said main combustion chamber of said internal combustion engine, and a second ignition chamber part which communicates with said first ignition chamber part and has a circumferential wall with an inner parallel surface and a greater cross section than said first ignition chamber part; electrode means including an electrode supported on an insulator, and a mass electrode arranged in the region of transition between said first and second ignition chamber parts and forming together with said electrode an ignition spark gap, said second ignition chamber part being arranged adjacent to said first ignition chamber part at the side of said electrode, said electrode means including a heating resistor united with said insulator, said insulator having an insulator foot, said heating resistor being formed as an electrically conductive coating on said insulator foot; and means forming at least one overflow passage arranged to communicate the main combustion chamber with said ignition chamber, said overflow passage being open directly into said second ignition chamber part from said end wall of said first ignition chamber part and is located inside said inner parallel surface of said circumferential wall of said second ignition chamber.

4. An ignition plug for an internal combustion engine having a main combustion chamber for receiving a mixture, the ignition plug comprising means forming an ignition chamber including a first ignition chamber part which has an end wall which separates said first ignition chamber part from said main combustion chamber of said internal combustion engine and is completely sealed so that said first ignition chamber part does not directly communicate with said main combustion chamber, and a second ignition chamber part which communicates with said first ignition chamber part and has a circumferential wall with an inner parallel surface and a greater cross section than said first ignition chamber part; electrode means including an electrode supported on an insulator, and a mass electrode arranged in the region of transition between said first and second ignition chamber parts and forming together with said electrode an ignition spark gap, said second ignition chamber part being arranged adjacent to said first ignition chamber part at the side of said electrode; and means forming at least one overflow passage arranged to communicate the main combustion chamber with said ignition chamber, said overflow passage being open directly into said second ignition chamber part from said end wall of said first ignition chamber part and is located inside said inner parallel surface of said circumferential wall of said second ignition chamber so that said first ignition chamber part communicates with said main combustion chamber through said second ignition chamber part, said overflow passages additionally supplying said first ignition chamber part with said mixture over a route which goes on and along said electrode means.

5. An ignition plug as defined in claim 4, wherein said second ignition chamber is cylindrical and has a longitudinal axis, said overflow passage extending parallel to said longitudinal axis of said second ignition chamber part.

6. An ignition plug as defined in claim 4, wherein said ignition chamber parts has a circumferential direction, said overflow passage being inclined to said circumferential direction of said ignition chamber parts.

7. An ignition plug as defined in claim 4, wherein said overflow passage forming means form a plurality of such overflow passages, said overflow passages being uniformly distributed over said circumferential wall of said second ignition chamber.

8. An ignition plug as defined in claim 4, wherein said electrode means includes a heating resistor united with said insulator.

9. An ignition plug as defined in claim 8, wherein said heating resistor is composed of a PTC-resistance material.

10. An ignition plug as defined in claim 4, wherein said ignition chamber forming means includes a cap-shaped casing bounding said first ignition chamber part and includes said end wall and a flange extending substantially radially from the latter and formed as a cap brim, said overflow passage being formed in said flange of said casing.

11. An ignition plug as defined in claim 10, wherein said ignition chamber forming means includes a support and a hollow collar connected therewith, said second ignition chamber part being formed inside said hollow collar.

12. An ignition plug as defined in claim 11, wherein said collar has a free end, said cap-shaped casing being mounted on said free end of said collar.

* * * * *